US005588783A

United States Patent [19]

Brabston et al.

[11] Patent Number: 5,588,783

[45] Date of Patent: Dec. 31, 1996

[54] SOIL REINFORCEMENT WITH ADHESIVE-COATED FIBERS

[75] Inventors: William N. Brabston; Philip G. Malone, both of Vicksburg, Miss.

[73] Assignee: The United States of America as represented by the Secretary of the Army, Washington, D.C.

[21] Appl. No.: 880,414

[22] Filed: May 8, 1992

[51] Int. Cl.[6] ..... E02D 3/12

[52] U.S. Cl. ..... 405/258; 405/263

[58] Field of Search ..... 405/16, 19, 258, 405/263, 264, 265, 266

[56] References Cited

U.S. PATENT DOCUMENTS

| | | | |
|---|---|---|---|
| 2,789,399 | 4/1957 | Finn | 405/258 X |
| 2,842,897 | 7/1958 | Finn | 405/258 X |
| 4,273,476 | 6/1981 | Kotulla et al. | 405/258 |
| 4,645,381 | 2/1987 | Leflaive et al. | 405/258 |
| 4,669,919 | 6/1987 | Hilterhaus et al. | 405/264 |
| 4,790,691 | 12/1988 | Freed | 405/263 |
| 4,936,711 | 6/1990 | Sasahara | 405/263 |

*Primary Examiner*—John A. Ricci
*Attorney, Agent, or Firm*—Luther A. Marsh

[57] ABSTRACT

The reinforcement of soil to prevent erosion or strength loss, for example in berms and embankments, involves the addition of fibers having an adhesive coating to the soil. Both natural and synthetic fibers may be used. Degradable or non-degradable adhesives may be employed with a preferred adhesive being one which is moderately soluble in water.

12 Claims, No Drawings

SOIL REINFORCEMENT WITH ADHESIVE-COATED FIBERS

The present invention pertains to the stabilization of soil, for example, in earthen berms and embankments, and, more particularly, to the stabilization of soil by the incorporation of adhesive-coated fibers therein.

BACKGROUND OF THE INVENTION

In the past, fibrous strengthening elements have been added to soil by planting vegetation or by incorporating simple fibrous materials such as chopped nylon, dacron or polyester to the soil. The use of vegetation requires seeding, fertilizing and maintenance. The soil area to be stabilized must: be in a position that gives the vegetation access to sunlight and water. Using natural vegetation for soil stabilization also has the disadvantage that roots actively remove moisture from the soil and may cause changes in soil volume especially if expansive clays are present. In some situtations, such as embankments around fuel storage areas, vegetation cannot be used because of the dangers of fire.

Simple fibers with no adhesive have been used in the past: for soil stabilization, but soil does not bind to the simple fibers as it does to the sticky surface of a root. The favored fiber types have been synthetic fibers such as nylon, dacron and polyester. The objection has been made that these fibers, in general, do not wet well and soil does not adhere well to the untreated fiber. Further, these fibers are not "natural materials" and will remain in the soil indefinitely because they are not biodegradable. Untreated natural fibers, for example, cotton or wood fibers, degrade too rapidly to be useful for anything more than temporary stabilization.

It is a primary object of the present invention to provide an improved method of soil stabilization.

It is also an object of the present invention to provide such a method of soil stabilization employing fibers having increased soil adhesion properties.

It is also an object of the present invention to provide a method of soil stabilization which is characterized by economies in material and manufacturing effort.

SUMMARY OF THE INVENTION

The above and other objects of the invention which will become apparent hereinafter are achieved by the use of an adhesive coating on soil reinforcing or stabilizing fibers. Both natural and synthetic fibers may be used as may either a degradable or a non-degradable adhesive.

For a more complete understanding of the invention and the objects and advantages thereof, reference should be had to the following detailed description wherein preferred embodiments of the invention are described.

DESCRIPTION OF THE PREFERRED EMBODIMENTS

The present invention provides for the reinforcement or stabilization of soil, such as that used in forming berms or embankments, by incorporating into the soil fibers that have been provided with an adhesive coating. The adhesive coating material causes soil particles to adhere to the fiber in much the same manner as soil particles adhere to the sticky surfaces of plant roots.

A wide variety of fiber types and configurations may be employed. Among the types of fibers are: organic natural fibers such as cotton fibers, wood fibers and other cellulosic fibers; organic synthetic fibers such as nylon, dacron, polyester; inorganic natural fibers such as zeolites and asbestos; inorganic synthetic fibers such as glass fibers or slag wool. Shaped synthetic fibers can be coated with degradable or non-degradable adhesive. Fibers of two or more of the listed types may also be blended together. The fibers, either natural or synthetic, may be coated and formed or joined together to create complex shapes. Long, single fibers may also be employed.

The adhesive coating material may be either a degradable or a non-degradable one. Where a permanent fiber is not desired, a degradable adhesive, such as a vegetable gum can be used on a cellulose fiber. The coating material may also be used to increase the resistance of fibers to fire, insects, and other environmental effects that weaken the fibers. If less expensive degradable fibers are coated to increase their durability, it is possible to substitute these fibers for the more expensive non-degradable synthetic materials and save on the costs of the basic materials.

The use of an adhesive that is moderately soluble in water and will spread out through the soil surrounding the fiber provides an additional advantage in that the adhesive, spreading through the soil, causes the soil particles near the fiber to adhere to each other as well as to the fiber itself.

A preferred embodiment of the invention consists of a composite cotton and polyester fiber that is coated with gelled sodium silicate. This coating can be produced by dipping the fiber in a full strength solution of sodium silicate (42 degree Baume). When dried, the fiber becomes stiff. The fiber can be mixed with the soil either as a wet fiber or as a dry fiber. Moisture in the soil spreads the adhesive out into the soil. The soil around the fiber forms a mass that adheres to the fiber. The highly alkaline soidum silicate solution slows the biodegradation of the fiber and makes the fiber fire-resistant.

Fibers with adhesive can bind effectively, therefore it is also possible to realize an additional ecomony by using fewer fibers per unit volume of soil to obtain a given soil strength. The same slope can be stabilized with fewer fibers per unit volume if the fibers are the more efficient adhesive-coated fibers.

Adhesive-coated fibers can also be used with other soil stabilization methods. For example, sodium silicate coated fibers can be used with lime and/or portland cement incorporation in soil to increase the shear strength of the lime and/or portland cement-treated soil.

While preferred embodiments of the invention have been described in detail herein, it will be understood that changes and additions may be had therein and thereto without departing from the spirit of the invention. Reference should, accordingly, be had to the appended claims in determining the true scope of the invention.

What is claimed is:

1. A method of soil reinforcement, comprising:

providing at least one fiber;

coating said at least one fiber with an adhesive material;

mixing said coated at least one coated fiber with the soil, thereby adding strength and cohesion to the soil and reducing erosion and shear failure in the soil.

2. The method of claim 1 wherein said at least one fiber consists of a relatively long, single fiber and said step of coating comprises coating said fiber with a degradable adhesive.

3. The method of claim 1 wherein said at least one fiber consists of a relatively long, single fiber and said step of coating comprises coating said fiber with a non-degradable adhesive.

4. The method of claim 1 wherein said at least one fiber comprises a plurality of natural organic fibers and said step of coating comprises coating said fiber with a degradable adhesive.

5. The method of claim 1 wherein said at least one fiber comprises a plurality of natural organic fibers and said step of coating comprises coating said fiber with a non-degradable adhesive.

6. The method of claim 1 wherein said at least one fiber comprises a plurality of synthetic organic fibers and said step of coating comprises coating said fiber with a degradable adhesive.

7. The method of claim 1 wherein said at least one fiber comprises a plurality of synthetic organic fibers and said step of coating comprises coating said fiber with a non-degradable adhesive.

8. The method of claim 1 wherein said at least one fiber comprises a mixture of a plurality of natural and synthetic organic fibers and said step of coating comprises coating said fiber with a degradable adhesive.

9. The method of claim 1 wherein said at least one fiber comprises a mixture of a plurality of natural and synthetic organic fibers and said step of coating comprises coating said fiber with a non-degradable adhesive.

10. The method of claim 1 wherein said at least one fiber comprises a plurality of inorganic fibers.

11. The method of claim 6 wherein said fibers comprise shaped synthetic fibers.

12. The method of claim 7 wherein said fibers comprise shaped synthetic fibers.

* * * * *